US007789819B2

(12) United States Patent
Slovencik

(10) Patent No.: US 7,789,819 B2
(45) Date of Patent: Sep. 7, 2010

(54) CUTTING DEVICE FOR CUSHIONING DUNNAGE PRODUCING MACHINE

(75) Inventor: Jean-Marc Slovencik, Uhrwiller (FR)

(73) Assignee: Storopack, Inc., Cincinnati, OH (US)

( * ) Notice: Subject to any disclaimer, the term of this patent is extended or adjusted under 35 U.S.C. 154(b) by 188 days.

(21) Appl. No.: 11/738,676

(22) Filed: Apr. 23, 2007

(65) Prior Publication Data

US 2008/0261794 A1 Oct. 23, 2008

(51) Int. Cl.
*B31B 1/36* (2006.01)

(52) U.S. Cl. ..... 493/464; 493/365; 493/967; 83/487; 83/488

(58) Field of Classification Search ..... 493/464, 493/967, 340, 365, 370, 372; 83/746, 440, 83/444, 469, 471, 483, 485, 487, 488
See application file for complete search history.

(56) References Cited

U.S. PATENT DOCUMENTS

| | | | | |
|---|---|---|---|---|
| 3,574,270 | A * | 4/1971 | Rosendahl | 53/281 |
| 5,007,319 | A * | 4/1991 | Armbruster | 83/488 |
| 5,474,208 | A * | 12/1995 | Ball | 221/1 |
| 5,766,736 | A | 6/1998 | Baumuller | 428/198 |
| 5,897,481 | A | 4/1999 | Baumuller | 493/464 |
| 6,033,354 | A | 3/2000 | Baumuller | 493/464 |
| 6,106,452 | A | 8/2000 | Baumuller | 493/464 |
| 6,170,227 | B1 | 1/2001 | Kovacs et al. | 53/64 |
| 6,341,473 | B1 | 1/2002 | Kovacs et al. | 53/450 |
| 6,468,197 | B1 * | 10/2002 | Lencoski et al. | 493/464 |
| 6,534,148 | B1 | 3/2003 | Baumuller | 428/126 |
| 6,802,467 | B2 * | 10/2004 | Abba et al. | 242/167 |

FOREIGN PATENT DOCUMENTS

| | | |
|---|---|---|
| DE | 19520907 A1 | 1/1996 |
| DE | 19538319 C1 | 12/1996 |
| EP | 0523382 A2 | 1/1993 |
| WO | 2006/087511 | 8/2006 |
| WO | 2008/030743 | 3/2008 |

OTHER PUBLICATIONS

Paul Deis, *Cushioning Product And Method*, U.S. Patent Application No. US 2003/O009988 A1 published Jan. 16, 2003.
Kenneth L. Shaw et al, *Apparatus For And Method of Producing And/Or Separating a String Of Interconnected Packing Cushions*, U.S. Patent Publication No. US 2006/O010835 A1 published Jan. 19, 2006.
Slovencik, Jean Paul, et al, *Stock Material, Inflatable Cushioning Product, and Method*, U.S. Patent Application Publication No. US 2006/O210738 A1 published Sep. 21, 2006.
Slovencik, Jean-Marc, et al, *Cushioning Product And Method And Apparatus For Making Same*, U.S. Patent Application Publication No. US 2007/O122575 A1 published May 31, 2007.

* cited by examiner

*Primary Examiner*—Christopher Harmon
(74) *Attorney, Agent, or Firm*—Wood, Herron & Evans, LLP

(57) ABSTRACT

A cushioning dunnage producing machine comprises a crumpler, a roll of paper sheet material having a first end at a radially innermost location and a second end at a radially outermost location, the first end fed into the crumpler, the crumpler drawing the paper sheet from the roll and crumpling the paper sheet into cushioning dunnage, and a cutter which travels laterally across the cushioning dunnage to cut the dunnage into a strip of a desired length.

11 Claims, 4 Drawing Sheets

CUTTING DEVICE FOR CUSHIONING DUNNAGE PRODUCING MACHINE

FIELD

Figure 1:
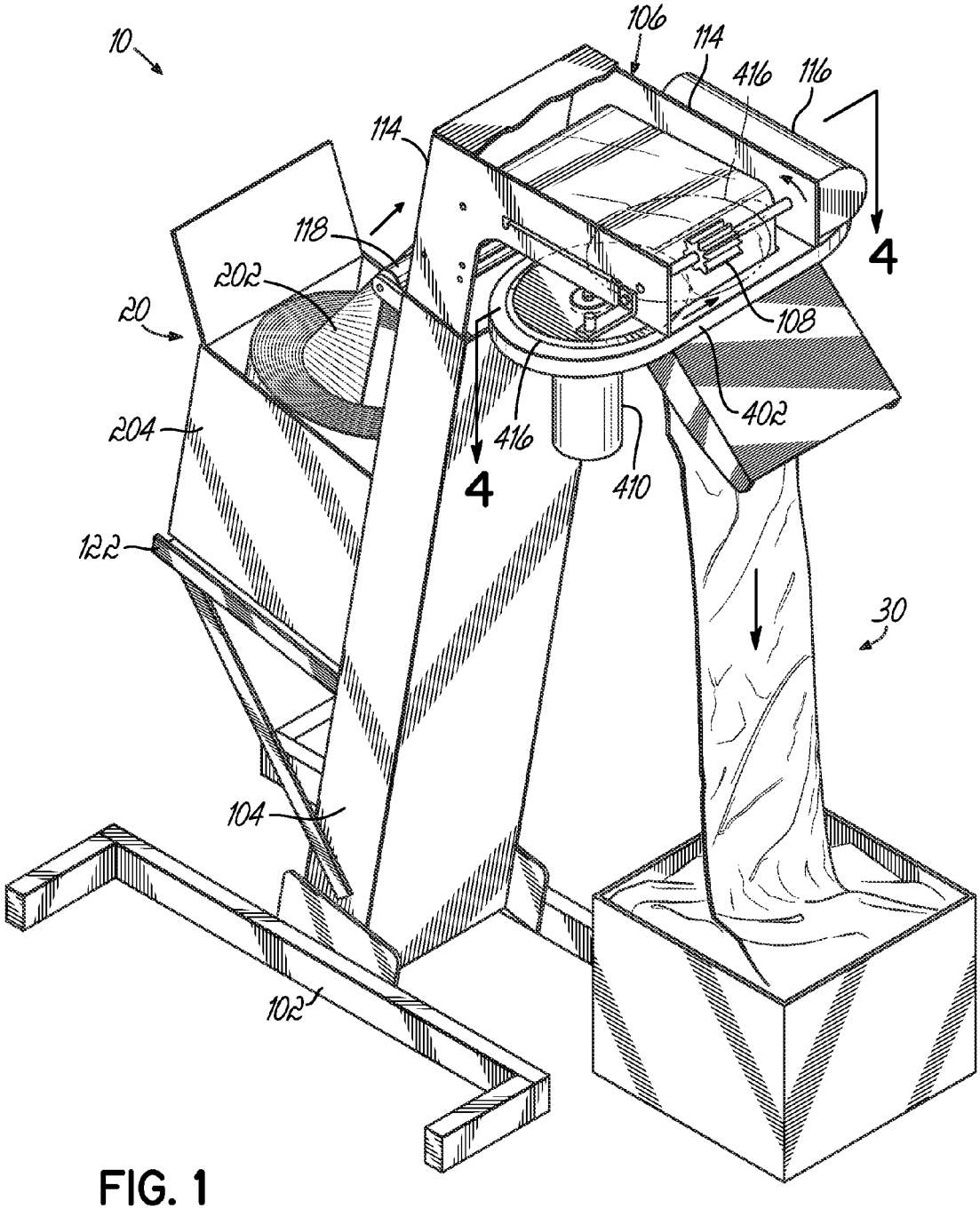

This relates generally to cushioning products, and more specifically to a cushioning product of the type formed by crumpling (sometimes referred to as "converting") paper sheet material.

BACKGROUND

In the process of shipping an item from one location to another, a protective packaging material is typically placed in the shipping carton or box, to fill any voids and/or to cushion the item during the shipping process. Examples of protective packaging materials are foam "peanuts," air filled plastic "pillows," and paper sheet material "converted" into cushioning pads.

A number of machines have been proposed for crumpling or "converting" paper sheet into cushioning pads or "dunnage." One particularly commercially successful machine is disclosed in U.S. Pat. No. 6,106,452 for Machines And Methods For Making Cushioning Dunnage Products By Crumpling Paper, hereby incorporated by reference herein as if fully set forth in its entirety. In dunnage producing machines in general, a roll of paper sheet is rotatably supported on the frame of the machine. The leading end of the paper sheet is fed into the machine, the machine draws the paper sheet into it by rotating the roll of paper (i.e. unrolling the roll), and the machine crumples the paper into dunnage.

The amount of paper which can be utilized is limited due to size and weight considerations. First, since the machine itself carries the roll of paper, the machine must be able to physically accommodate the size of the roll. While it would be desirable to have the machine be able to handle larger rolls of paper to reduce downtime of the machine due to the machine having to be refilled by an operator, a larger roll requires a larger machine to handle the larger physical size of the roll and/or a heavier machine (or a machine with a redesigned base) to avoid tipping of the machine, etc. Second, the rotational moment of inertia of a larger roll of paper creates problems for the machine in drawing the paper off the roll. Once the roll reaches a certain weight (and hence a certain rotational moment of inertia), the force required to draw (unroll) the paper from the roll exceeds the tensile strength of the paper, thus causing the paper to tear.

Dunnage producing machines such as the one shown in U.S. Pat. No. 6,106,452 and discussed above, and shown in U.S. Pat. No. 3,603,216, include a forming/folding/rolling apparatus to form/fold/roll the paper sheet prior to crumpling, to add thickness/resilience to the finished dunnage product. Such forming/folding/rolling apparatus adds cost and complexity to the dunnage machine.

It is desirable to be able to utilize larger rolls of paper for dunnage machines without suffering from the aforementioned disadvantages of larger rolls.

It is also desirable to be able to eliminate forming/folding apparatus from the dunnage machine.

To that end, the assignee developed the cushioning dunnage producing machine disclosed in U.S. patent application Ser. No. 11/517,658, hereby incorporated by reference herein as if fully set forth in its entirety. That machine comprises a crumpler, a roll of paper sheet material having a first end at a radially innermost location and a second end at a radially outermost location, the first end fed into the cushioning dunnage producing machine, the crumpler drawing the paper sheet from the roll and crumpling the paper sheet into cushioning dunnage.

It is desirable to equip the dunnage producing machine of U.S. patent application Ser. No. 11/517,658 with a device for cutting the dunnage into strips of the desired length.

SUMMARY

A cushioning dunnage producing machine comprises a crumpler, a roll of paper sheet material having a first end at a radially innermost location and a second end at a radially outermost location, the first end fed into the crumpler, the crumpler drawing the paper sheet from the roll and crumpling the paper sheet into cushioning dunnage, and a cutter which travels laterally across the cushioning dunnage to cut the dunnage into a strip of a desired length.

The cutter can include a circular cutting blade that rotates as the blade travels across the cushioning dunnage. The cutter can include a rack and pinion gear assembly associated with the cutting blade for rotating the cutting blade and translating the cutting blade. An electric motor can be associated with the rack and pinion gear assembly for rotating the cutting blade and translating the cutting blade. The cutter can further include a mounting plate to which the cutting blade, rack and pinion gear assembly, and motor are mounted.

In a specific but otherwise nonlimiting embodiment, the cutter can comprise a mounting plate having first and second transverse slots therethrough, the cushioning dunnage passing through the first slot, a rack gear mounted on one side of the mounting plate adjacent the second slot, an electric motor having an output shaft, a pinion gear mounted on the output shaft of the electric motor and positioned to engage the rack gear, the output shaft of the electric motor passing through the second slot to the other side of the mounting plate, and a circular cutting blade mounted to the end of the output shaft and positioned on the other side of the mounting plate, the cutting blade and first and second slots being sized and arranged so that as the blade travels from one end of the rack gear to the other end of the rack gear the blade travels across the first slot to sever the dunnage.

Other features of the dunnage producing machine can be as follows. The roll can be positioned standing on end. The sheet can twist about a longitudinal axis of the sheet into a helix as the sheet is drawn from the roll and into the machine. The machine can comprise a base and a support extending upwardly from the base, the crumpler mounted on said support. The crumpler can comprise a pair of opposed rollers, at least one of which is driven. The pair of opposed rollers can comprise a driven roller and an idler roller. The driven roller and idler roller can be mounted for relative movement therebetween such that a distance between the driven roller and idler roller can be adjusted to vary an amount of compression imparted to the paper sheet. The machine can further comprise a motor for driving the driven roller. The machine can further comprise a pair of guide rollers mounted to at least one of the support and crumpler to aid in transitioning the sheet from the roll to the crumpler. The machine can further comprise a roll supporting platform mounted to the support for supporting the roll of paper sheet material.

In another aspect, a cushioning dunnage producing machine comprises a frame, a crumpler mounted on the frame for drawing paper sheet from a supply thereof and crumpling the paper sheet into cushioning dunnage, and a cutter mounted on the frame which travels laterally across the cushioning dunnage to cut the dunnage into a strip of a desired length.

In yet another aspect, a cutter for a machine which produces cushioning dunnage comprises a mounting plate having first and second transverse slots therethrough, the first slot being adapted for the cushioning dunnage to pass therethrough, a rack gear mounted on one side of the mounting plate adjacent the second slot, an electric motor having an output shaft, a pinion gear mounted on the output shaft of the electric motor and positioned to engage the rack gear, the output shaft of the electric motor passing through the second slot to the other side of the mounting plate, and a circular cutting blade mounted to the end of the output shaft and positioned on the other side of the mounting plate, the cutting blade and first and second slots being sized and arranged so that as the blade travels from one end of the rack gear to the other end of the rack gear the blade travels across the first slot to sever the dunnage.

DRAWINGS

Figure 2:
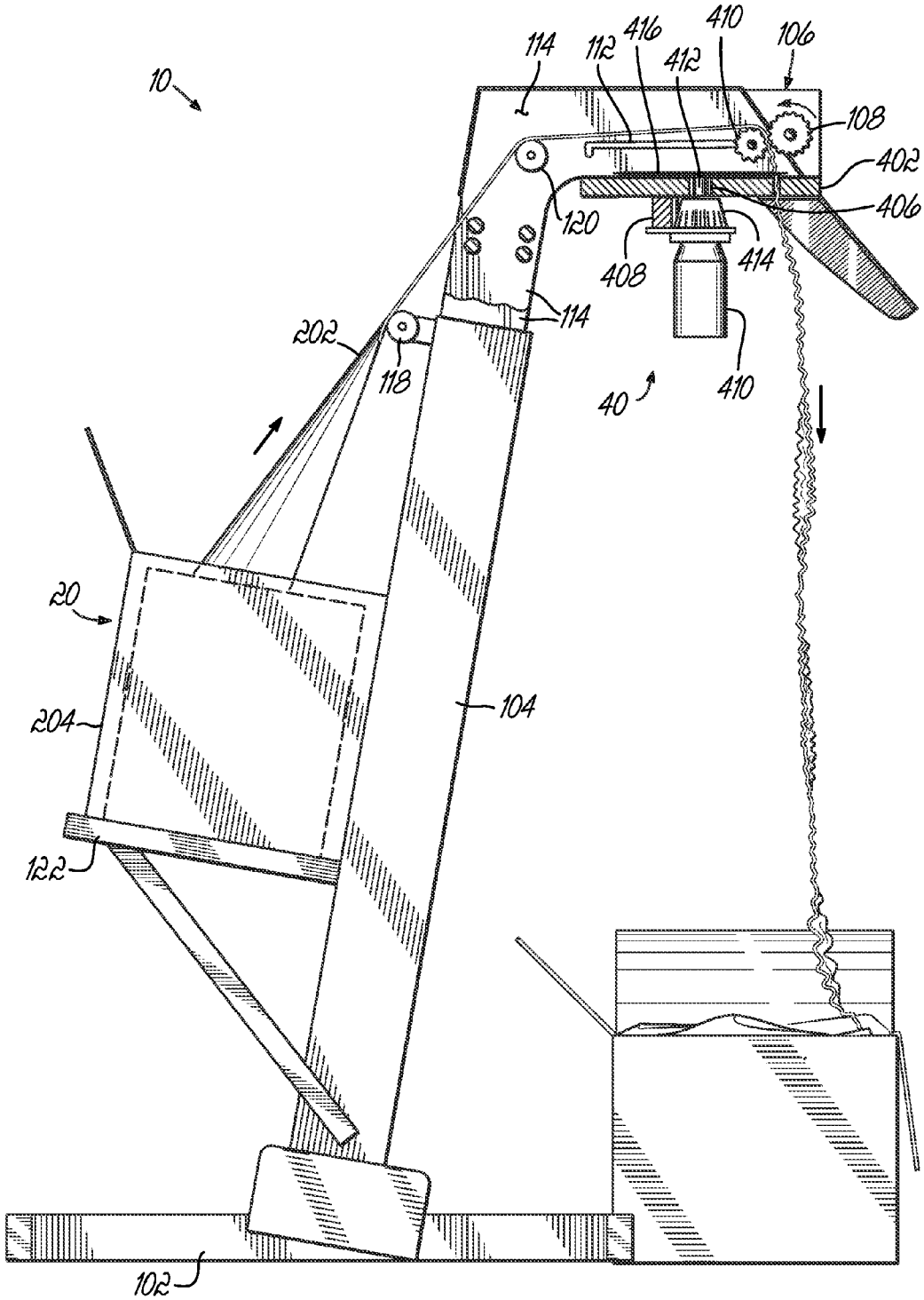
Figure 3:
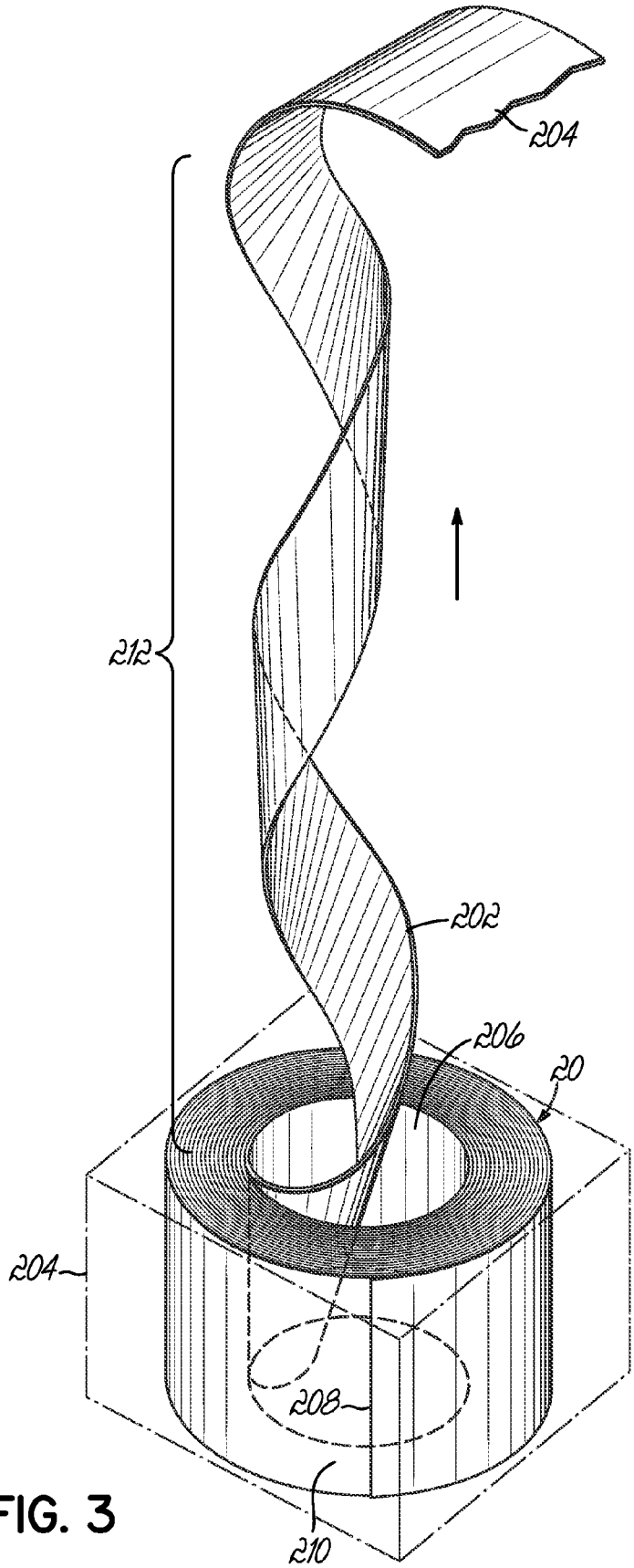
Figure 4:
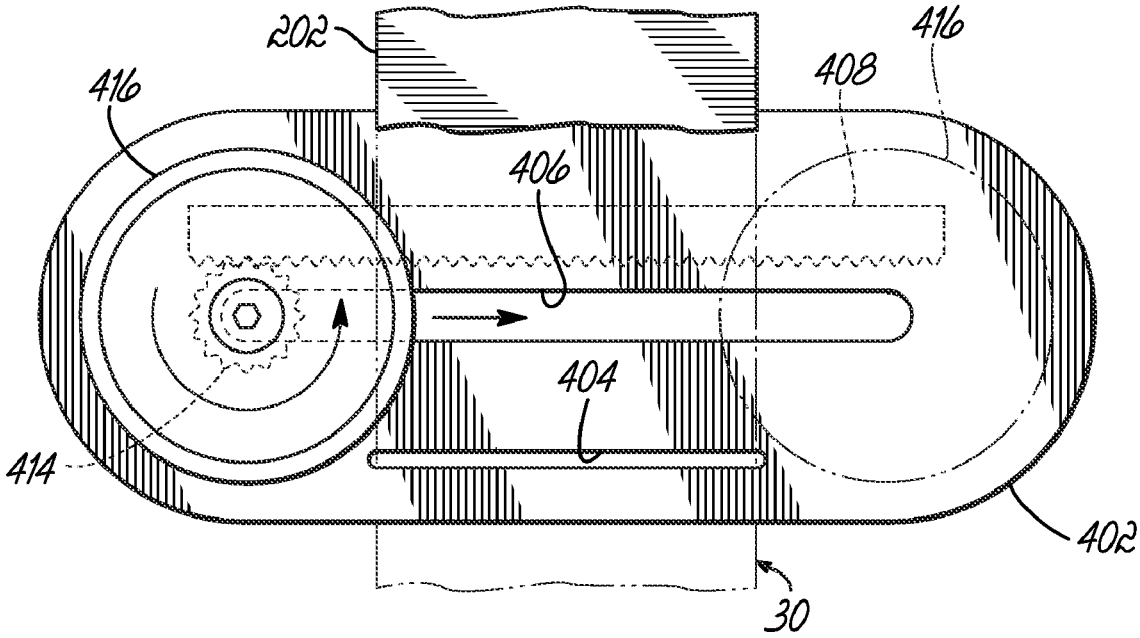

FIG. 1 is a perspective view of a cushioning dunnage producing machine and a roll of paper sheet material, FIG. 2 is a side view in partial cross-section of the machine and material of FIG. 1, FIG. 3 is a perspective view of the roll of paper sheet material as it is unrolled from a first end at a radially innermost location of the roll and as it is twisted about its longitudinal axis into a helix as it is drawn off of the roll and into the machine of FIGS. 1 and 2, and FIG. 4 is a view taken along line 4-4 in FIG. 1.

DESCRIPTION

Referring first to FIGS. 1 and 2, a cushioning dunnage producing machine 10, a roll 20 of paper sheet material for feeding the machine 10, and the resulting cushioning dunnage 30 produced by the machine 10, are illustrated.

Machine 10 can include a base 102, a support 104 extending upwardly from the base 102, and a crumpler 106 mounted on the support 104. Crumpler 106 can be in the form of a driven roller 108 which can cooperate with an idler roller 110 to crumple the paper sheet 202 being unrolled from the roll 20, as will be described in more detail below. Idler roller 110 can be mounted in parallel tracks 112, 112 in sides 114, 114 of crumpler 106 to provide a means of adjusting the distance between the crumpling roller 108 and the idler roller 110 and hence the amount of compression, or crumple, imparted to the sheet 202. Driven roller 108 can be driven by a motor, for example electric motor 116, which can be mounted to a side 114 of the crumpler 106. An additional pair of guide rollers 118 and 120 can be mounted to the support 104 and/or crumpler 106 to aid in transitioning the sheet 202 from the roll 20 to the crumpler 106. A roll supporting platform 122 can be mounted to the support 104 for supporting the roll 20 of paper sheet material. In the alternative, the roll 20 can simply be placed on a supporting surface, such as a table top, floor, etc., and at any orientation to include upright (vertical), horizontal, and any inclination therebetween. Roll 20 can be placed in a box 204 supported on platform 122. Other types of dunnage producing machines can be employed in the practice of the method other than the machine 10 illustrated. For example, dunnage producing machines of the types shown in U.S. Pat. Nos. 6,106,452 and 3,603,216 can be employed in the practice of the method.

Referring now to FIG. 3, the roll 20 of paper sheet 202 is illustrated as it is unrolled from, i.e. drawn off of, the roll 20 and into the machine 10 of FIGS. 1 and 2. The roll 20 of paper sheet 202 has a first end 204 which is originally located at a radially innermost location 206, and a second end 208 located at a radially outermost location 210. (Since, as purchased, a typical roll 20 of paper sheet 202 comes wound on a stiff inner cardboard tube, the tube is first removed from the interior of the roll 20 of paper 202.) As the first end 204 of the paper sheet 202 is fed into the cushioning dunnage producing machine 10, the sheet 202 twists about a longitudinal axis of the sheet 202 into a helix 212. The helix 212 of paper sheet 202 is then crumpled with the rollers 108, 110.

The dunnage producing method thus permits larger rolls of paper to be utilized without the size and weight of the roll necessitating changes in the design of the machine and/or causing the paper to tear during feeding into the machine. And, forming/folding/rolling apparatus to form/fold/roll the paper sheet prior to crumpling, such as that shown in U.S. Pat. Nos. 6,106,452 and 3,603,216, is not required since unrolling the roll "from the inside out" generates a paper sheet helix, i.e. forms/folds/rolls the paper sheet without any such forming/folding/rolling apparatus per se.

Referring now to FIGS. 1, 2, and 4, machine 10 includes a cutter 40 for cutting the cushioning dunnage 30 into a desired length. Cutter 40 an include a mounting plate 402 having first and second transversely extending slots 404, 406, respectively therethrough. The first slot 404 is for the cushioning dunnage 30 to pass through. A rack gear 408 can be mounted on one side, for example lower side, of the plate 402 adjacent the second slot 406. An electric motor 410 has an output shaft 412. A pinion gear 414 can be mounted on the output shaft 412 of the electric motor 410 and positioned to engage the rack gear 408. The output shaft 412 of the electric motor 410 can pass through the second slot 406 to the other side, for example upper side, of the mounting plate 402. A circular cutting blade 416 can be mounted to the end of the output shaft 412 and positioned on the other side of the mounting plate 402. The cutting blade 416 and first and second slots 404, 406 are sized and arranged so that as the blade 416 travels from one end of said rack gear 408 to the other end of said rack gear 408, the blade 416 rotates and travels across the first slot 404 to sever the dunnage 30.

The embodiments shown and described are merely for illustrative purposes only. The drawings and the description are not intended to limit in any way the scope of the claims. Those skilled in the art will appreciate various changes, modifications, and alternative embodiments. For example, while the cutter has been shown and described in conjunction with one particular type of dunnage producing machine and one particular type of paper feed ("from the inside out"), the cutter can also be used with other types of dunnage producing machines and other types of paper feed. All such changes, modifications and embodiments are deemed to be embraced by the claims. Accordingly, the scope of the right to exclude shall be limited only by the following claims and their equivalents.

What is claimed is:

1. A cushioning dunnage producing machine for producing dunnage from a roll of paper sheet material, said machine comprising:

a crumpler adapted to draw the paper sheet material from the roll and crumple the paper sheet material into cushioning dunnage, and a cutter which travels laterally across the cushioning dunnage to cut the dunnage into a strip of a desired length, wherein said cutter comprises:

a mounting plate having first and second transverse slots therethrough, the cushioning dunnage passing through said first slot, a rack gear mounted on one side of said mounting plate adjacent said second slot, an electric motor having an output shaft, a pinion gear mounted on said output shaft of said electric motor and positioned to engage said rack gear, said output shaft of said electric motor passing through said second slot to the other side of said mounting plate, and a circular cutting blade mounted to an end of said output shaft and positioned on said other side of said mounting plate, said cutting blade and first and second slots being sized and arranged so that as said blade travels from one end of said rack gear to the other end of said rack gear said blade travels across said first slot to sever the dunnage.

2. The dunnage producing machine of claim 1 wherein the roll is positioned standing on end, has a first end at a radially innermost location and a second end at a radially outermost location, and the first end is fed into said crumpler.

3. The dunnage producing machine of claim 2 wherein the sheet twists about a longitudinal axis of the sheet into a helix as the sheet is drawn from the roll and into said machine.

4. The dunnage producing machine of claim 1 wherein said machine comprises a base and a support extending upwardly from said base, said crumpler mounted on said support.

5. The dunnage producing machine of claim 4 wherein said crumpler comprises a pair of opposed rollers, at least one of which is driven.

6. The dunnage producing machine of claim 5 wherein said pair of opposed rollers comprises a driven roller and an idler roller.

7. The dunnage producing machine of claim 6 wherein said driven roller and idler roller are mounted for relative movement therebetween such that a distance between said driven roller and idler roller can be adjusted to vary an amount of compression imparted to the paper sheet material.

8. The dunnage producing machine of claim 6 wherein said machine further comprises a motor for driving said driven roller.

9. The dunnage producing machine of claim 4 wherein said machine further comprises a pair of guide rollers mounted to at least one of said support and said crumpler to aid in transitioning the sheet material from the roll to said crumpler.

10. The dunnage producing machine of claim 4 wherein said machine further comprises a roll supporting platform mounted to said support for supporting the roll of paper sheet material.

11. A cushioning dunnage producing machine comprising:

a frame, a crumpler mounted on said frame for drawing paper sheet from a supply thereof and crumpling the paper sheet into cushioning dunnage, and a cutter mounted on said frame which travels laterally across the cushioning dunnage to cut the dunnage into a strip of a desired length, wherein said cutter comprises:

a mounting plate having first and second transverse slots therethrough, the cushioning dunnage passing through said first slot, a rack gear mounted on one side of said mounting plate adjacent said second slot, an electric motor having an output shaft, a pinion gear mounted on said output shaft of said electric motor and positioned to engage said rack gear, said output shaft of said electric motor passing through said second slot to the other side of said mounting plate, and a circular cutting blade mounted to an end of said output shaft and positioned on said other side of said mounting plate, said cutting blade and first and second slots being sized and arranged so that as said blade travels from one end of said rack gear to the other end of said rack gear said blade travels across said first slot to sever the dunnage.

* * * * *